United States Patent [19]

Kira et al.

[11] Patent Number: 4,742,749

[45] Date of Patent: May 10, 1988

[54] LID STRUCTURE OF ELECTRONIC MUSICAL INSTRUMENT

[75] Inventors: Yasuhiro Kira; Toshiyuki Yamamura, both of Hamamatsu, Japan

[73] Assignee: Nippon Gakki Seizo Kabushiki Kaisha, Hamamatsu, Japan

[21] Appl. No.: 27,305

[22] Filed: Mar. 18, 1987

[30] Foreign Application Priority Data

Mar. 24, 1986 [JP] Japan ..... 61-63913
Feb. 6, 1987 [JP] Japan ..... 62-24759

[51] Int. Cl.[4] ..... G10C 3/02
[52] U.S. Cl. ..... 84/179; 84/DIG. 17
[58] Field of Search ..... 84/177, 178, 179, DIG. 17

[56] References Cited

U.S. PATENT DOCUMENTS 4,040,335 8/1977 Oliver et al. ..... 84/DIG. 17
4,656,913 4/1987 Yoshikawa ..... 84/DIG. 17

FOREIGN PATENT DOCUMENTS 58-50362 11/1983 Japan .
59-13645 4/1984 Japan .

*Primary Examiner*—Patrick R. Salce
*Assistant Examiner*—Jeffrey Sterrett
*Attorney, Agent, or Firm*—Blakely, Sokoloff, Taylor & Zafman

[57] ABSTRACT

A lid for an electronic musical instrument is disposed to be vertically pivotal about a pivot and covers a keyboard section of a musical instrument body when it is closed. In the lid structure, the pivot is arranged at a position separated forward from the rear end of the lid and downward from the lower surface of the lid by predetermined distances, respectively, and the rear end portion of the lid is housed, when it is opened, in the musical instrument body through an opening formed in the upper surface of the musical instrument body.

5 Claims, 3 Drawing Sheets

LID STRUCTURE OF ELECTRONIC MUSICAL INSTRUMENT

BACKGROUND OF THE INVENTION p The

The present invention relates to a lid structure which is best suited for an electronic musical instrument, such as an electronic organ, and does not obstruct the field of view of the performer when a lid is open.

As conventional lids for covering a keyboard section of an electronic musical instrument such as an electronic organ, a slide lid (Japanese Utility Model Publication No. 59-13645) which is arranged to be slidable in a back-and-forth direction, and is housed in a musical instrument body when it is open, and a pivot lid (Japanese Utility Model Publication No. 58-50362) which is arranged to be vertically pivotal and vertically stands on the musical instrument body when it is open are known.

The former slide lid is constituted by coupling a plurality of lid constituting members in series to be foldable, like a shutter. Thus, its structure is complicated, and a large number of parts are required, resulting in high manufacturing cost. Since the slide lid is slid along the upper surface of a top plate arranged on the inner surface of the musical instrument body, it is easily rattled. In particular, a thin, lightweight type lid tends to rattle. Thus, the lid can be slid along a guide groove. In this case, a gap between the guide groove and the slide lid poses a problem. More specifically, when a small gap is set, a resistance between the slide lid and the guide groove becomes large, and the slide lid cannot be smoothly slid. Contrary to this, if a large gap is set, the slide lid is easily rattled, and noise generated upon opening/closing the lid is considerable.

When the slide lid is fully opened, it is completely housed in the musical instrument body. Therefore, a large housing space is required, and the total depth of the instrument is undesirably increased.

Meanwhile, the latter pivot lid vertically stands on the musical instrument body when it is open, and no housing space is required in the instrument body. However, if two or more of keyboards are arranged, the depth of the pivot lid is increased, and the weight of the lid itself is increased. Thus, the opening/closing operation is not easy. In particular, the pivot lid may be suddenly closed by itself upon shift of the center of gravity when the lid is opened or closed. Thus, a performer may pinch his hands between the lid and the body, resulting in poor safety. If the lid has a large depth, it occupies a large area, and this may obstruct the field of view of a performer. Therefore, a pivot lid of this type is unsuitable for an electronic musical instrument having two or more keyboards.

SUMMARY OF THE INVENTION

It is the principle object of the present invention to provide a lid structure for an electronic musical instrument, which has a simple structure, and can be easily manufactured with low cost.

It is another object of the present invention to provide a lid structure for an electronic musical instrument, which can be easily opened and closed with high safety.

In order to achieve the above objects, there is provided, in an electronic musical instrument comprising a lid which is disposed to be vertically pivotal about a pivot and covers a keyboard section and/or an operation panel of a musical instrument body when it is closed, a lid structure for the electronic musical instrument, wherein the pivot is arranged at a position separated forward from the rear end of the lid and downward from the lower surface of the lid by predetermined distances, respectively, and the rear end portion of the lid is housed, when the lid is opened, in the musical instrument body through an opening formed in the upper surface of the musical instrument body.

DESCRIPTION OF THE PREFERRED EMBODIMENTS

An embodiment of the present invention will now be described with reference to the accompanying drawings.

Figure 1:
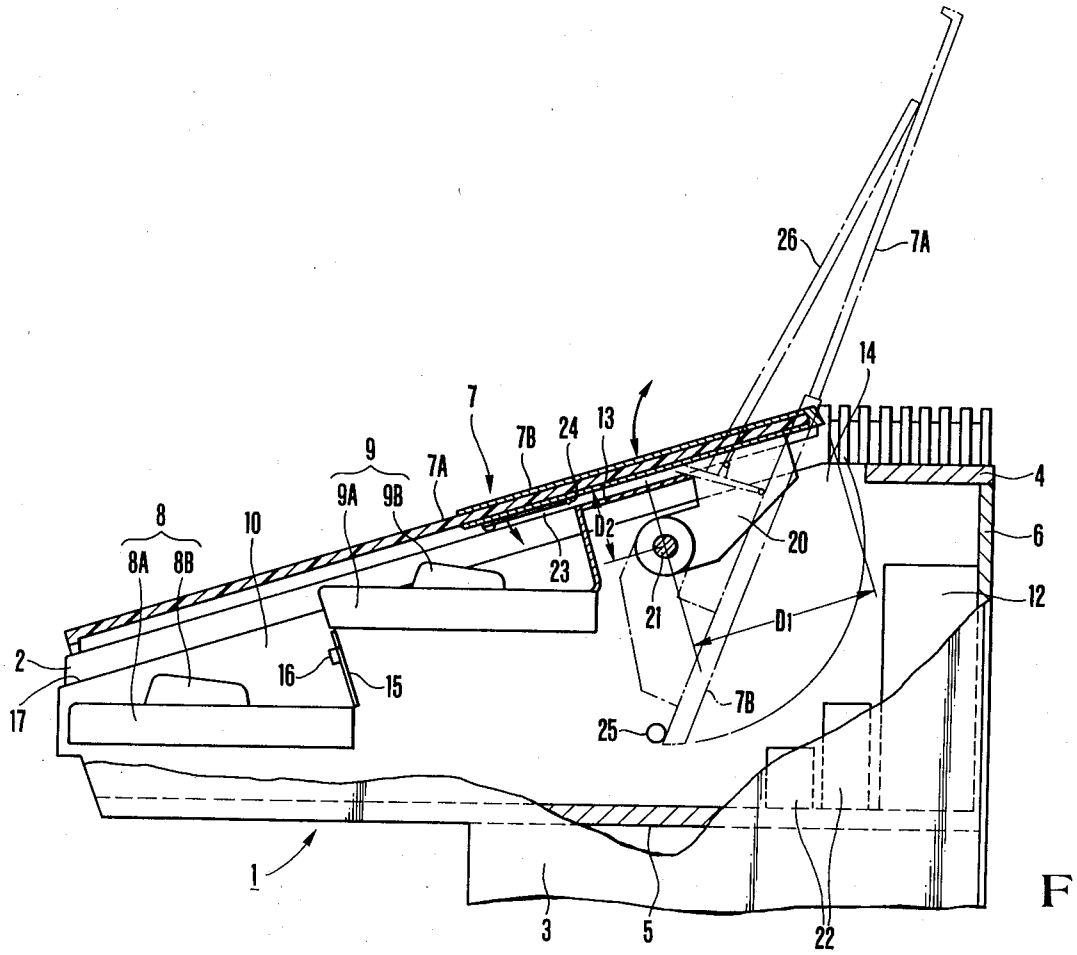
FIG. 1 is a side sectional view showing an embodiment of an electronic musical instrument employing a lid structure according to the present invention.
Figure 2:
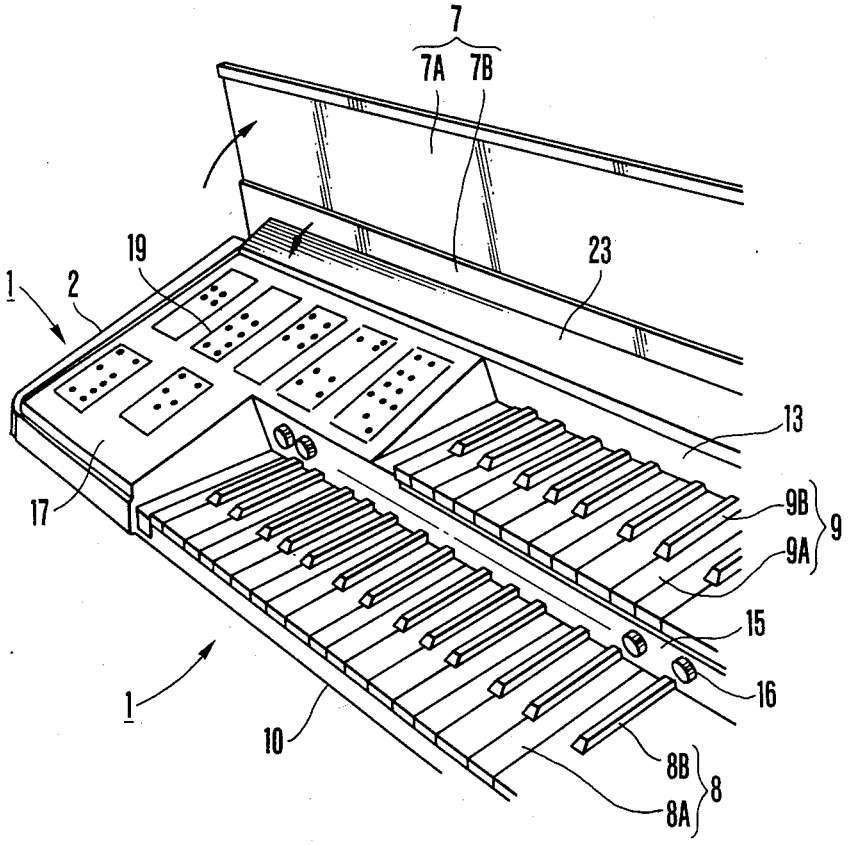
FIG. 2 is a perspective view of the main part while opening a lid.

Referring to FIGS. 1 and 2, a musical instrument body 1 has an elongated shallow box shape, constituted by a pair of right and left side plates 2 and 3, a top plate 4, a bottom plate 5, a back plate 6, and a lid 7. The front half portion of the musical instrument body is open upward to constitute a keyboard section 10. A lower keyboard 8 consisting of a large number of white keys 8A and black keys 8B and an upper keyboard 9 consisting of a large number of white keys 9A and black keys 9B are disposed on the keyboard section 10. The rear ends of the lower and upper keyboards 8 and 9 are supported by a keyboard frame (not shown) disposed on the bottom plate 5 to be vertically movable. Upon depression of keys, key switches (not shown) corresponding to the keys are operated, and a musical tone forming circuit in electronic parts 22 is thus operated, thereby producing electronic tones. An electronic circuit 12 is arranged along the inner surface of the back plate 6 in the rear portion of the musical instrument body 1.

A substantially L-shaped first panel 13 is arranged above and behind the upper keyboard 9. An opening 14 is formed between the rear end of the first panel 13 and the front end of the top plate 4 to extend along the total width of the musical instrument body 1. A second panel 15 is arranged between the front end of the upper keyboard 9 and the rear end of the lower keyboard 8. Operation members 16 for various electronics parts, e.g., a registration switch and the like are arranged on the surface of the panel 15. Operation panels 17 are arranged at both sides of the lower and upper keyboards 8 and 9, and a large number of operation members 19 are arranged on the surfaces of the panels 17.

The lid 7 is mounted on the musical instrument body 1 to be vertically pivotal (openable/closable). When the lid 7 is closed, it covers the keyboard section 10 to protect the lower and upper keyboards 8 and 9 and the operation members 16 and 19. The lid 7 is constituted by a first lid member 7A formed of a transparent or a semi-transparent plastic material, and an elongated second lid member 7B having a U-shaped cross section, formed of, e.g., aluminum, for holding the rear half portion of the first lid member 7A. A pair of fulcrum members 20 are disposed on the side portions on the rear end side of the lower surface of the second lid member 7B. Each fulcrum member 20 has a substantially L shape, so that its bent portion extends forward. The distal end portions of the pair of fulcrum members 20 are pivotally supported by a shaft 21. The shaft 21 is suspended between the pair of side plates 2 and 3, and the pair of fulcrum members 20 are inserted in the musical instrument body from the opening 14 of the body 1. In this case, the shaft 21, serving as a fulcrum of the lid 7, supports the fulcrum members 20, and is separated forward from the rear end of the lid 7 and downward from the lower surface of the lid 7 by given distances Dl and D2, respectively. A music stand 23 is pivotally disposed on the front end portion of the lower surface of the second lid member 7B through a hinge 24.

In the electronic musical instrument having the above arrangement, the lid 7 covers the keyboard section 10 and the operation panels 17 when it is closed, and protects the lower and upper keyboards 8 and 9. The lid 7 may be of such a short length as to cover only a part of the keyboard section 10 and/or the operation panel 17. The two side end portions of the first lid member 7A are supported by the upper surfaces of the slide plates 2 and 3, and the rear end portion of the second lid member 7B closes the opening 14. When the lid 7 is pivoted upward about the shaft 21 in this state, the second lid member 7B can be substantially completely housed in the musical instrument body 1, as indicated by alternate long and short dashed lines in FIG. 1, and abuts against stopper pins 25 to be locked at a lid open position. In this state, the first lid member 7A stands on the musical instrument body 1 to be inclined obliquely backward. Then, when the music stand 23 is opened and its distal end abuts against the first panel 13, the music stand 23 closes part of the opening 14, i.e., an opening portion between the second lid member 7B and the first panel 13. Thus, a music 26 is placed on the music stand 23, and is rested against the first lid member 7A.

Note that the stopper pins 25 project from the inner surfaces of the side plates 2 and 3.

With the lid structure having the above arrangement, the structure of the lid 7 is simple, and the lid 7 is pivoted about the shaft 21. Thus, the lid 7 can be smoothly opened or closed without being rattled. In particular, since the shaft 21 is arranged below and near the rear end of the lid 7, a distance between the center of gravity of the lid and the fulcrum is small although the lid 7 has a relatively large depth, and a moment around the fulcrum due to self weight is small. Therefore, the lid can be prevented from being suddenly closed, thereby guaranteeing safe opening/closing operation. Since the rear end portion of the lid 7 is housed in the musical instrument body 1, the exposed area of the lid 7 is decreased accordingly and does not obstruct the field of view of a performer. Therefore, the lid structure of the present invention is best suited for an electronic musical instrument having two or more keyboards. Since only the rear end portion of the lid 7 is housed, the housing space can be reduced, and the depth of the musical instrument body 1 need not be increased. Since the front half portion of the lid 7 comprises the first lid member 7A formed of a transparent or semitransparent material, obstruction of the field of view when the lid is opened can be further eliminated. In addition, since the music stand 23 closes a portion of the opening 14 in front of the lid 7 when the lid is opened, the interior of the musical instrument body 1 cannot be seen, resulting in a good outer appearance and thereby preventing foreign matter, dust, and the like from entering therein.

Figure 3:
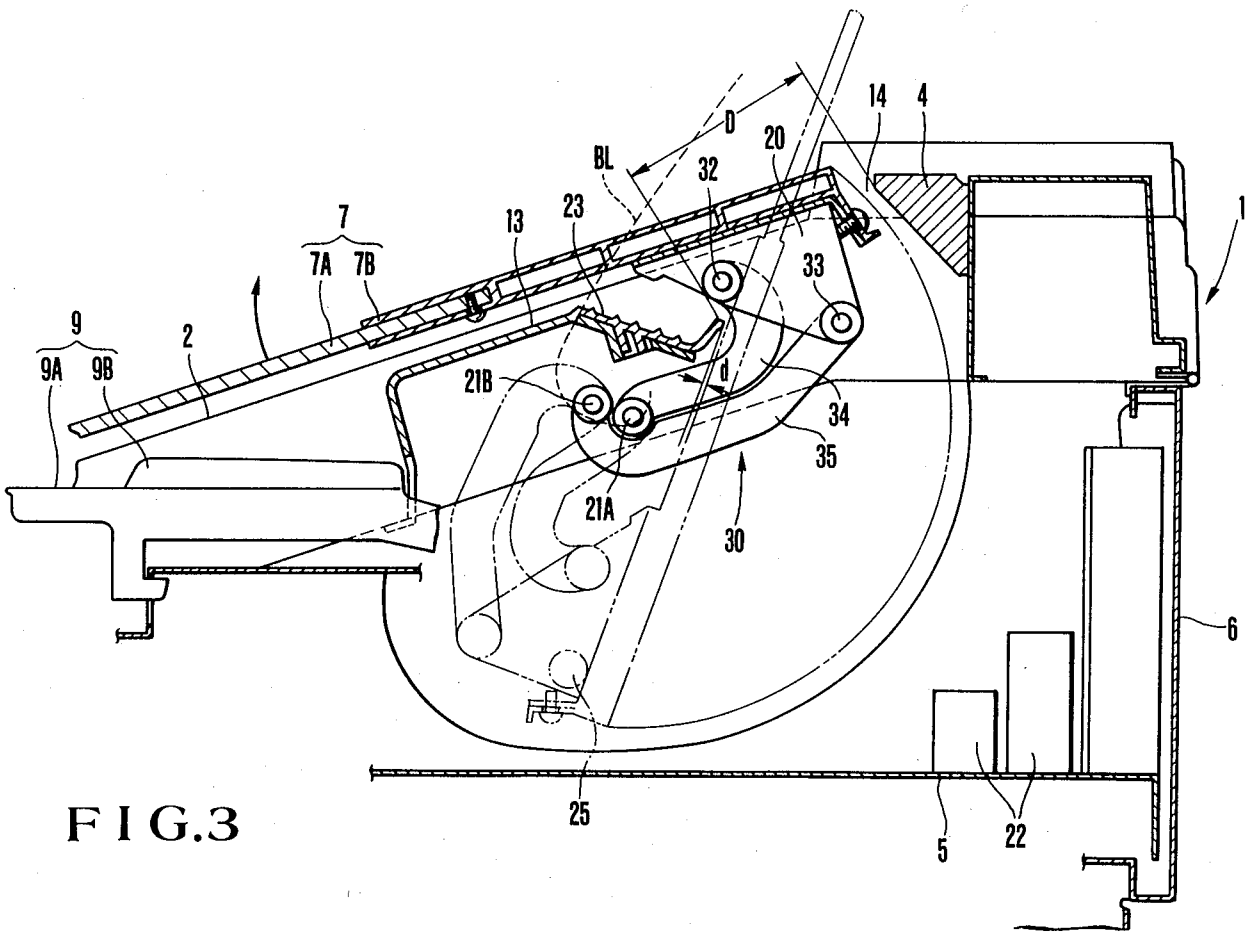
FIG. 3 is a side sectional view showing the main part according to another embodiment of the present invention.

FIG. 3 shows another embodiment of the present invention. The same reference numerals in FIG. 3 denote the same parts as in FIGS. 1 and 2, and a detailed description thereof will be omitted. The embodiment shown in FIG. 3 and the embodiment shown in FIGS. 1 and 2 are the substantially the same, except that the rear end portion of the lid 7 is held by a four-link rotating mechanism 30 which is coupled in a rotating contrapositional manner, and the music stand 23 is arranged along the rear edge of the first panel 13.

The four-link rotating mechanism 30 comprises a substantially triangular fulcrum member 20 fixed to the rear end operation of the lower surface of the second lid member 7B, first and second shafts 21A and 21B which are arranged below the music stand 23 in the musical instrument body 1 to be adjacent to each other, and first and second links 34 and 35, one end of each of which is pivotally supported by the first or second shaft 21A or 21B and the other end of each of which is pivoted at a position different from that of other link to a pin (movable shaft) 32 or 33 so as to hold the lid 7. The shaft 21A is arranged on the rear side adjacent to the shaft 21B, and the pin 33 is arranged obliquely below the pin 32. The first link 34 is shorter than the second link 35, and is bent to have a J shape so as not to interfere with the rear end portion of the music stand 23. Similarly, the second link 35 is bent to a J shape so as not to interfere with the first shaft 21A. However, the shapes of the first and second links 34 and 35 are determined according to the positional relationship between themselves and the music stand 23 and the positional relationship therebetween. Therefore, the present invention is not limited to the shapes described above. If the links 34 and 35 are arranged to be separated outwardly from the music stand 23 in the thickness direction, they can be formed to have linear shapes.

The music stand 23 is fixed along the rear end of the first panel 13, and defines the front edge of the opening 14 formed in the upper surface of the musical instrument body 1.

In the lid structure having the above arrangement, the first and second links 34 and 35 are pivoted upon opening/closing operation of the lid 7 while restricting each other's movement. The locus of the instantaneous center of movement when a line connecting the pins 32 and 33 moves is as indicated by a broken curve BL shown in FIG. 3. The fulcrum member 20 and the links 34 and 35 are coupled to be relatively pivotal through the pins 32 and 33. Thus, when the lid 7 is gradually opened, the angles of the lid 7 with respect to the links 34 and 35 are changed. Therefore, while the lid 7 is rotated, its rear end goes down to be drifted downward and forward, and the final position of the lid 7 when opened is before the final open position of the lid in the structure shown in FIG. 1. As a result, if the lids of the two embodiments in FIGS. 1 and 3 stand at the same inclination angle, a back-and-forth width D of the opening 14 of the musical instrument body 1 can be reduced in the structure shown in FIG. 3 since the lid 7 is stopped before the final stop position of the structure in FIG. 1. At the same time, a distance d between the lid 7 and the music stand 23 can be minimized when the lid is open. As a result, entrance of dust, dropping of pencils and the like can be satisfactorily prevented.

Figure 4:
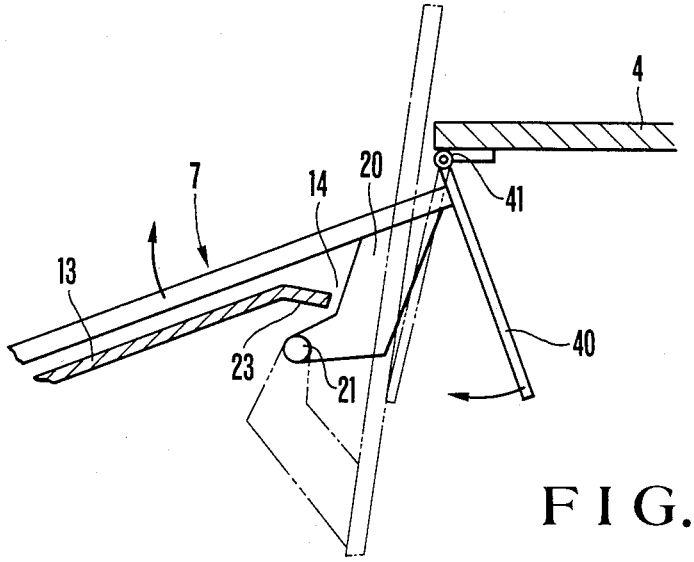
FIG. 4 is a side sectional view showing the main part according to still another embodiment of the present invention.

FIG. 4 shows still another embodiment of the present invention.

In this embodiment, a gap between the lid 7 and the top plate 4 upon opening of the lid 7 is closed by a dust cover 40. The upper end of the dust cover 40 is pivotally mounted on the front end portion of the lower surface of the top plate 4 through a hinge 41, and is biased in the closing direction, i.e., is applied with a clockwise pivoting force in FIG. 4, by a coil spring (not shown) arranged in the hinge 41. When the lid 7 is closed, the dust cover 40 is locked at the open position indicated by the solid line by the rear end of the lid 7. When the lid 7 is opened, the dust cover 40 is urged against the surface of the lid 7.

Therefore, with the above arrangement, a gap between the top plate 4 and the. lid 7 can be closed by the dust cover 40. When the lid is open, the dust cover 40 biases the lid 7 in the opening direction to stably hold it. When the lid is closed, the dust cover 40 serves as a damper for preventing the lid from being suddenly closed.

In the above embodiment, the pivot of the lid 7 is constituted by the single shaft 21, but can be constituted by two stationary shafts, i.e., first and second shafts 21A and 21B and two movable shafts, i.e., pins 32 and 33, using the four-link rotating mechanism, in the same as in the embodiment shown in FIG. 3.

In the lid structure of the electronic musical instrument according to the present invention, the pivot of the lid which is vertically pivotally arranged on the musical instrument body is arranged to be separated forward from the rear end of the lid and downward from the lower surface of the lid by given distances, respectively. Therefore, the lid member, although it has a large depth, can be smoothly opened/closed. The lid structure of the present invention is best suited for an electronic musical instrument having two or more keyboards. When the lid is open, the rear end portion of the lid is housed in the musical instrument body. Therefore, the lid does not obstruct the field of view of a performer. In addition, the lid has a simple structure and can be easily manufactured with low cost.

What is claimed is:

1. In an electronic musical instrument comprising a lid which is disposed to be vertically pivotal about a pivot and covers a keyboard section and/or an operation panel of a musical instrument body when it is closed, a lid structure for said electronic musical instrument, wherein said pivot is arranged at a position separated forward from a rear end of said lid and downward from a lower surface of said lid by predetermined distances, respectively, and a rear end portion of said lid is housed, when the lid is opened, in said musical instrument body through an opening formed in an upper surface of said musical instrument body.

2. A lid structure according to claim 1, wherein a front half portion of said lid is formed of a transparent or semitransparent material.

3. A lid structure according to claim 1, wherein said lid has a music stand, and said opening of said musical instrument body is closed by said music stand when said lid is opened.

4. A lid structure according to claim 1, wherein said lid is held by a four-link rotating mechanism which is coupled in a rotating contrapositional manner.

5. A lid structure according to claim 4, wherein a music stand defines a front edge of said opening of said musical instrument body.

* * * * *